United States Patent [19]

Vannikov et al.

[11] 4,368,254

[45] Jan. 11, 1983

[54] NON-SILVER LIGHT-SENSITIVE COMPOSITION

[76] Inventors: Anatoly V. Vannikov, Teply stan, 2 mikroraion, korpus 20, kv. 29; Vadim G. Glotov, ulitsa Melnikova, 27, kv. 53; Antonina D. Grishina, ulitsa Vavilova, 44, korpus 3, kv. 77; Valentina N. Ivanova, ulitsa Geroev Panfilovtsev, 3, korpus 1, kv. 210; Vladimir S. Fedorov, ulitsa 26 Bakinskikh komissarov, 3, korpus 1, kv. 58; Gennady M. Chernov, Bolshaya Cheremushkinskaya ulitsa, 2, korpus 2, kv. 33; Vladimir E. Kazarinov, Leninsky prospekt, 11, kv. 126, all of Moscow, U.S.S.R.

[21] Appl. No.: 230,066

[22] Filed: Jan. 29, 1981

Related U.S. Application Data

[63] Continuation of Ser. No. 68,471, Aug. 20, 1979, abandoned.

[51] Int. Cl.[3] ..... G03C 1/52

[52] U.S. Cl. ..... 430/333; 430/344; 430/336; 430/337

[58] Field of Search ..... 430/344, 336, 333, 337

[56] References Cited

U.S. PATENT DOCUMENTS

| | | | |
|---|---|---|---|
| 3,490,907 | 1/1970 | Schenck et al. | 430/344 |
| 3,502,476 | 3/1970 | Itano et al. | 430/344 |
| 3,533,792 | 10/1970 | Petro et al. | 430/336 |
| 3,647,448 | 3/1972 | De Meyer et al. | 430/616 |
| 3,772,029 | 11/1973 | Hoshino et al. | 430/344 |

FOREIGN PATENT DOCUMENTS

| | | | |
|---|---|---|---|
| 957,192 | 5/1964 | United Kingdom | 430/344 |

*Primary Examiner*—Won H. Louie, Jr.
*Attorney, Agent, or Firm*—Steinberg & Raskin

[57] ABSTRACT

A non-silver light-sensitive composition according to the invention consists of the following components, in percent by weight;

| | |
|---|---|
| a hydroxyderivative of naphthalene | 1 to 10 |
| an aromatic amine | 29 to 60 |
| saturated halogenated hydrocarbon | 35 to 29 |
| a polymeric binder | 35 to 1. |

The composition of the present invention makes it possible to produce light-sensitive layers which have an increased sensitivity ($2\times10^{-4}$ J/cm$^2$ at 365 nm) and a low optical fog density (D. below 0.05).

8 Claims, No Drawings

NON-SILVER LIGHT-SENSITIVE COMPOSITION

This is a continuation of application Ser. No. 68,471, filed Aug. 20, 1979, abandoned.

FIELD OF THE INVENTION

The present invention relates to compositions of light-sensitive materials and, more specifically, to non-silver light-sensitive compositions which are useful in photography, reprography, microfilm production, microelectronics.

BACKGROUND OF THE INVENTION

Known in the art are non-silver light-sensitive compositions featuring a high resolving power, lack of "wet" processes of treatment and fixation and recording of an image on a real time scale. These processes may be exemplified by the diazotype process, wherein a diazo film (or diazo paper) incorporating a complex aromatic compound is exposed to UV-light. At the regions exposed to UV-light the diazo compound is decomposed. As a result, an image is formed which is further fixed by means of treatment of the layer with ammonia vapours. Diazotype layers have a low sensitivity of $10^{-1}$ J/cm$^2$ and provide no opportunity for obtaining half-tone pictures, thus necessitating the use of special equipment for the development and fixation of the image.

The prior art composition most resembling that of the present invention (prototype) is a non-silver light-sensitive composition incorporating an aromatic amine (1 to 20% by weight) a saturated halogenated hydrocarbon (in an amount of from 5 to 35% by weight) a polymeric binder (10 to 80% by weight); in this case the fixation is effected by a thermal treatment of the exposed layer. The heat treatment is conducted at a temperature ranging from 90° to 190° C. for a period of from 15 sec to 5 min (cf. U.S. Pat. No. 3,764,334). This silverless light-sensitive composition only has a low sensitivity, since the minimal energy of a mercury lamp required to obtain, within the visible light region of spectrum, an optical density equal to 1 characterizing the layer sensitivity, is equal to $10^{-2}$ J/cm$^2$. This hampers the practical use of the light-sensitive layers produced on the basis of this prototype composition. It should be noted that a low sensitivity of the layer is a typical feature of organic light-sensitive systems and constitutes a principal disadvantage as compared to silver-halide light-sensitive layers. Furthermore, the layers produced on the basis of this composition have a high fog optical density, reaching 0.2–0.4 optical density unit. This prior art silverless light-sensitive composition does not make it possible to obtain a colour image.

SUMMARY OF THE INVENTION

It is an object of the present invention to provide a non-silver light-sensitive composition which has an increased sensitivity, a low optical density of the fog, permits production of the original gradations and provides a multi-colour and relief image.

This object is accomplished by a non-silver light-sensitive composition incorporating as color forming component an aromatic amine, a saturated halogenated hydrocarbon and a polymeric binder, wherein according to the present invention as antifogging component a hydroxyderivative of naphthalene is also present and the components are present in the following proportions, in percent by weight:

| | |
|---|---|
| naphthalene hydroxyderivative | 1 to 10 |
| aromatic amine | 29 to 60 |
| saturated halogenated hydrocarbon | 35 to 29 |
| film-forming polymeric binder | 35 to 1. |

As the hydroxyderivative of naphthalene use may be made of such compounds as alpha-naphthol, beta-naphthol, 1-naphtholphthalein, aminonaphthol, dihydroxynaphthalene.

DETAILED DESCRIPTION OF THE INVENTION

The present invention is further illustrated in the following manner.

To prepare a non-silver light-sensitive composition, a polymeric binder in an amount of from 1 to 35% by weight is dissolved in dichloroethane, toluene or acetone, heated to boiling.

As the polymeric binder use may be made of such compounds as polystyrene, polymethylmethacrylate, polyvinylacetate, polyvinylchloride, polycarbonate. Then, in the resulting organic solution of the polymeric binder the hydroxyderivative of naphthalene is dissolved in an amount of 1 to 10% by weight, the aromatic amine in an amount of from 29 to 60% by weight and the saturated hydrocarbon in an amount of from 29 to 35% by weight.

As the hydroxyderivative of naphthalene use may be made of such compounds as alpha-naphthol, beta-naphthol, 1-naphtholphthalein,aminonaphthol, dihydroxynaphthalene. As the aromatic amine use can be made of such compounds as diphenylbenzylamine, indole or dibenzylaniline; as the saturated hydrocarbon use may be made of such compounds as carbon tetrabromide or iodoform. Depending on the employed aromatic amine, a silverless light-sensitive composition is produced which gives images of a different colour, i.e. blue when diphenylbenzylamine is used, red—when indole is used, yellow—dibenzylaniline. The resulting organic solutions are intermixed and applied to the surface of a substrate which may be made of glass, porcelain, metal, ceramics, paper, or a polymeric layer.

Drying is carried out in darkness at room temperature for 1–2 minutes when applied onto paper and for 0.5–2 hours when the non-silver light-sensitive composition is applied onto any other substrate. The thus-produced light-sensitive layer is exposed through a negative by UV-light. Where paper is used as the substrate, the light-sensitive layer is exposed to UV-light with the power of $10^{-4}$ W/cm$^2$ for 90 seconds, while in all other cases the light-sensitive layer is exposed to UV-light with the intensity of $10^{-4}$ W/cm$^2$ for 2 seconds.

In order to intensify the resulting image, the exposed layer is uniformly lighted with an intensive intense visible light (with the power of from 0.1 to 1.0 W/cm$^2$) for a period of from 1 to 5 minutes. Then the layer is subjected to a thermal treatment at a temperature of from 100° to 140° C. for 1 to 30 minutes. During the heat-treatment the resulting image is fixed. The fixed image can be stored in light for a long time.

To produce a non-silver light-sensitive composition enabling the production of a multi-colour image on paper, this composition is prepared following the procedure mentioned hereinabove but the film-forming polymeric material is used in an amount ranging from 1 to 10% by mass.

The use of the polymeric binder in an amount exceeding 10% by mass and below 1% by mass results in a lowered resolution of the resulting multi-colour image.

The multi-colour image is produced by way of a multilayer application, onto paper by the method of applying solutions of non-silver light-sensitive composition each incorporating an aromatic amine corresponding to one of primary colours (blue, red, yellow). These silverless light-sensitive compositions are applied onto the substrate in an arbitrary sequence. Upon such application of the non-silver light-sensitive composition containing an aromatic amine, the substrate paper is impregnated with the solution of the silverless light-sensitive composition. After drying, the employed solvent is removed while the light-sensitive components are distributed over the surface and within the bulk of the paper. Under the effect of actinic light a visual image is formed within the superficial layer of the paper. Fixation of the resulting image is effected by way of a heat-treatment.

The above-described operations are repeated until all silverless light-sensitive compositions are applied, exposed and fixed on the paper, each including an aromatic amine corresponding to one simple colour, whereby a multi-colour image is produced.

The possibility of application of layers in this manner is ensured by two factors: a film is not formed at the surface of paper and the paper retains its porosity and capability of being repeatedly impregnated with a solution of the non-silver light-sensitive composition; secondly, the dye formed within the superficial layer of the paper during the exposure and heat-treatment is insoluble in the solvents employed. In this manner, as a result of a repeated application of a silverless light-sensitive composition, the primary image is not blurred and no colour fog is formed, while non-silver light-sensitive compositions are distributed over the surface and within the bulk of the paper. Exposure and heat-treatment of this paper also results in the formation of an image. As a result of these operations in the superficial layer of the paper there are distributed coloured centers corresponding to all the compositions applied. This makes it possible to obtain the colours corresponding to the silverless light-sensitive compositions applied and ensuring their superposition, i.e. to obtain a multi-colour image.

To obtain a relief image, the compositions according to the present invention should incorporate a polyvinylchloride as a polymeric binder. Exposure and intensification of the image are carried out following the above-described procedure and the heat treatment is conducted at a temperature within the range of from 220° to 260° C. for a period of 2–3 minutes. The resulting image has the property that upon treatment with boiling dichloroethane or acetone for 10 minutes, the non-exposed regions of the layer are washed out and the relief coloured image remains. The relief depth is defined by the layer thickness and may vary within the range of from 0.1 to 100 mcm.

In comparison with the prior art silverless light-sensitive composition, the composition according to the present invention makes it possible to produce light-sensitive layers which possess an increased sensitivity ($2\times10^{-4}$ J/cm$^2$ at 365 nm), a low optical fog density ($D_o \leqq 0.05$), improved gradation characteristics (the layer transmits 22 gradations of optical wedge and makes it possible to produce a relief image. It is also possible to make recording of black-white and coloured (single-colour and multi-colour) images on the layers. For a better understanding of the present invention the following Examples illustrating the light-sensitive non-silver composition are given hereinbelow.

EXAMPLE 1

To prepare a non-silver light-sensitive composition, polystyrene in the amount of 15% by weight is dissolved in 100 ml of toluene heated to boiling. Then to the solution cooled to room temperature there are added 1% by weight of α-naphthol, 55% by weight of diphenylbenzylamine and 29% by weight of carbon tetrabromide. The solution is applied onto paper, dried for 2 minutes at room temperature and the light-sensitive layer is exposed to UV-light with the power of $10^{-4}$ W/cm$^2$ for 90 seconds. Then the light-sensitive layer is subjected to a heat-treatment at the temperature of 130° C. for 2 minutes.

A blue colour image is obtained. The layer sensitivity is $10^{-2}$ J/cm$^2$; the layer transmits at least 22 gradations of the optical wedge within the range of optical density values of from 0.1 to 3.5. The fog density is equal to 0.05 optical density unit.

EXAMPLE 2

A non-silver light-sensitive composition is prepared in a manner similar to that described in the foregoing Example 1. The composition incorporates 20% by weight of polymethylmethacrylate, 1.0% by weight of α-naphthol, 50% by weight of indole, 29% by weight of carbon tetrabromide.

The solution is applied onto paper, dried for 2 minutes at room temperature and the resulting light-sensitive layer is exposed to UV-light with the power of $10^{-4}$ W/cm$^2$ for 90 seconds; then the layer is subjected to a heat-treatment for 2.5 minutes at the temperature of 120° C. A red image is thus produced. The layer sensitivity is $10^{-2}$ J/cm$^2$; the layer transmits at least 22 gradations of the optical wedge within the range of optical density values of from 0.1 to 3.5. The fog density is equal to 0.05 optical density units.

EXAMPLE 3

A non-silver light-sensitive composition is prepared following the procedure described in the foregoing Example 1. The composition incorporates 35% by weight of polyvinylacetate, 1.0% by weight of 1-naphtholphthalein, 29% by weight of dibenzylaniline and 35% by weight of iodoform. The solution is applied onto paper, dried for 2 minutes at room temperature and the resulting photosensitive layer is exposed to UV-light with the power of $10^{-4}$ W/cm$^2$ for 90 seconds, whereafter it is subjected to a heat-treatment at the temperature of 140° C. for 2 minutes. A yellow image is thus obtained. The layer sensitivity is equal to $10^{-2}$ J/cm$^2$, the layer gives at least 22 gradations of the optical wedge within the range of optical density values of from 0.1 to 3.5. The fog density is equal to 0.05 optical density units.

EXAMPLE 4

To produce a multi-colour image, three non-silver light-sensitive compositions are prepared separately.

First prepared is the composition producing a blue colour image.

Polystyrene in the amount of 10% by weight is dissolved in 100 ml of toluene heated to boiling. Then to the solution cooled to room temperature there are added 10% by weight of α-naphthol, 45% by weight of diphenylbenzylamine and 35% by weight of carbon tetrabromide.

The solution is applied onto paper, dried in darkness at room temperature for 2 minutes, exposed through a colour-separation negative corresponding to blue colour and subjected to a heat-treatment at the temperature of 120° C. for 1.5 minute. Onto the same paper the above-prepared solution of the non-silver light-sensitive composition mentioned hereinabove in toluene is also applied. This non-silver light-sensitive composition gives a red image and incorporates the following ingredients, in percent by weight:

| | |
|---|---|
| polystyrene | 1 |
| α-naphthol | 10 |
| indole | 60 |
| carbon tetrabromide | 29. |

The paper is dried in the dark at room temperature for one minute, exposed through a colour-separation negative corresponding to red colour and subjected to heat-treatment at the temperature of 100° C. for 2 minutes. Onto the same paper the solution of the non-silver light-sensitive composition in toluene prepared as described hereinabove is also applied. Said silverless light-sensitive composition provides a yellow image and incorporates the following ingredients, in percent by weight:

| | |
|---|---|
| polystyrene | 4 |
| α-naphthol | 1 |
| dibenzylaniline | 60 |
| carbon tetrabromide | 35. |

The paper is dried in the dark at room temperature for 2 minutes, exposed through a colour-separation negative corresponding to yellow colour and subjected to heat-treatment at the temperature of 100° C. for two minutes.

A multi-colour image is obtained having a full range of colours.

The layer sensitivity is equal to $10^{-2}$ J/cm$^2$; the layer transmits at least 22 gradations of the optical wedge within the range of optical density values of from 0.1 to 3.5. The fog density is equal to 0.05 optical density unit.

EXAMPLE 5

To prepare a non-silver light-sensitive composition, polyvinylchloride in the amount of 35% by weight is dissolved in 100 ml of dichloroethane heated to boiling. Then to the solution cooled to room temperature there are added 1% by weight of aminonaphthol, 29% by weight of diphenylbenzylamine and 35% by weight of carbon tetrabromide. The solution is applied onto a polyethyleneterephthalate substrate, dried for two hours and the resulting light-sensitive layer is exposed to UV-light with the power of $10^{-4}$ W/cm$^2$ for 2 seconds. The resulting image is intensified by uniformly subjecting the layer to an intensive visible light to the power of 0.1 W/cm$^2$ for 5 minutes and heat-treatment is further conducted at the temperature of 130° C. for 30 minutes. A blue image is thus obtained. The layer sensitivity is $2.10^{-4}$ J/cm$^2$, the layer transmits at least 22 gradations of optical wedge within the range of optical density values of from 0.1 to 3.5. The fog density is at most 0.05 optical density unit.

EXAMPLE 6

A non-silver light-sensitive composition is prepared following the procedure described in the foregoing Example 5; the composition incorporates 20% by weight of polycarbonate, 5% by weight of dihydroxynaphthalene, 45% by weight of indole and 30% by weight of carbon tetrabromide. The solution is applied onto a ceramic substrate, dried for one hour at room temperature and the resulting photosensitive layer is exposed to UV-light with the power of $10^{-4}$ W/cm$^2$ for two seconds. The resulting image is intensified by uniformly subjecting the layer to an intensive visible light with the power of 0.2 W/cm$^2$ for 4 minutes, followed by heat-treatment at the temperature of 120° C. for 25 minutes. A red image is obtained. The layer sensitivity is equal to $2.10^{-4}$ J/cm$^2$; the layer transmits at least 22 gradations of the optical wedge within the range of optical density values of from 0.1 to 3.5. The fog density is at most 0.05 optical density unit.

EXAMPLE 7

A non-silver light-sensitive composition is prepared following the procedure described in Example 5 hereinbefore; the composition incorporates 20% by weight of polymethylmethacrylate, 5% by weight of α-naphthol, 45% by weight of dibenzylaniline and 30% by weight of iodoform. The solution is applied onto a glass substrate, dried for 0.5 hour at room temperature and the resulting photosensitive layer is exposed to UV-light with the power of $10^{-4}$ W/cm$^2$ for two seconds. The thus-produced image is intensified by uniformly subjecting the layer to visible intensive light with the power of 0.5 W/cm$^2$ for 3 minutes, followed by a heat-treatment at the temperature of 140° C. conducted for 20 minutes. A yellow image is obtained. The layer sensitivity is $2.10^{-4}$ J/cm$^2$; the layer transmits at least 22 gradations of the optical wedge within the range of optical density values of from 0.1 to 3.5. The fog density is equal to at most 0.05 optical density unit.

EXAMPLE 8

To produce a non-silver light-sensitive composition, polyvinylchloride in the amount of 35% by weight is dissolved in 100 ml of dichloroethane heated to the boiling temperature. Then to the solution cooled to room temperature there are added 1% by weight of α-naphthol, 29% by weight of diphenylbenzylamine and 35% by weight of carbon tetrabromide. The solution is applied onto a metal substrate, dried for two hours at room temperature and the resulting light-sensitive layer is exposed to UV-light with the power of $10^{-4}$ W/cm$^2$ for two seconds. The resulting image is intensified by subjecting the layer to an intensive visible light with the power of 0.5 W/cm$^2$ for three minutes, followed by a heat-treatment at the temperature of 220° C. for 3 minutes. Then the layer is treated with boiling dichloroethane for 10 minutes. A dark-brown relief image is thus produced.

The layer sensitivity is equal to 2.10 J/cm$^2$; fog is totally absent.

EXAMPLE 9

A non-silver light-sensitive composition is prepared following the procedure described in Example 8. The composition contains 25% by weight of polyvinylchloride, 2% by weight of β-naphthol, 38% by weight of indole and 35% by weight of carbon tetrabromide. The solution is applied onto a glass substrate, dried for 1 hour at room temperature and the resulting photosensitive layer is exposed to UV-light with the power of $10^{-4}$ W/cm$^2$ for two seconds. The thus-produced image is intensified by subjecting the layer to an intensive visible light with the power of 0.8 W/cm$^2$ for two minutes and then a heat-treatment is conducted at the temperature of 240° C. for 2.5 minutes. Then the layer is treated with boiling acetone for 10 minutes. A relief dark-brown image is obtained. The layer sensitivity is equal to $2.10^{-4}$ J/cm$^2$; fog is totally absent.

EXAMPLE 10.

A non-silver light-sensitive composition is prepared following the procedure described in the foregoing Example 8. The composition incorporates 25% by weight of polyvinylchloride, 2% by weight of α-naphthol, 38% by weight of dibenzylaniline and 35% by weight of carbon tetrabromide. The solution is applied onto a glass substrate, dried for one hour at room temperature and the resulting light-sensitive layer is exposed to UV-light with the power of $10^{-4}$ W/cm$^2$ for two seconds. The thus-produced image is intensified by subjecting the layer to an intensive visible light with the power of 1.0 W/cm$^2$ for one minute and heat-treatment is conducted at the temperature of 260° C. for two minutes. Thereafter, the layer is treated with boiling dichloroethane at reflux for 10 minutes. A relief dark-brown image is obtained. The layer sensitivity is equal to $2.10^{-4}$; fog is completely absent.

What is claimed is:

1. A non-silver light-sensitive composition consisting of the following components, in percent by weight:

| | |
|---|---|
| a hydroxyderivative of naphthalene selected from the group consisting of α-naphthol, β-naphthol, 1-naphtholphthalein; aminonaphthol and dihydroxynaphthalene as anti fogging agent | 1 to 10 |
| an aromatic amine selected from the group consisting of diphenylbenzlamine, indole and dibenzylaniline as color former | 29 to 60 |
| a saturated halogenated hydrocarbon as photoactivator | 35 to 29 |
| a polymeric binder | 35 to 1. |

2. A non-silver light-sensitive composition according to claim 3, wherein as the saturated halogenated hydrocarbon use is made of carbon tetrabromide, iodoform.

3. A non-silver light-sensitive composition according to claim 2, wherein as the polymeric binder use is made of polystyrene, polymethylmethacrylate, polyvinylacetate, polyvinylchloride, polycarbonate.

4. Method of producing images, which comprises exposing to light on a substrate a non-silver light-sensitive composition consisting of, in percent by weight:

| | |
|---|---|
| a hydroxyderivative of naphthalene selected from the group consisting of α-naphthol, β-naphthol, 1-naphtholphthalein; aminonaphthol and dihydroxynaphthalene as anti fogging agent | 1 to 10 |
| an aromatic amine selected from the group consisting of diphenylbenzlamine, indole and dibenzylaniline as color former | 29 to 60 |
| a saturated halogenated hydrocarbon as photoactivator | 35 to 29 |
| a polymeric binder | 35 to 1. |

until a latent image is formed, intensifying the thus formed image by exposing the same to visible light with an intensity of 0.1 to 1.0 W/cm$^2$ for 1-5 minutes, and fixing the resulting image by heat treatment.

5. Method according to claim 4 wherein the heat treatment is effected at 100°-140° C. for 1-30 minutes.

6. Method according to claim 4 wherein the treatment is effected at a temperature of 220°-260° C. for a period of 2-3 minutes.

7. Method according to claim 6 wherein said polymeric binder is polyvinylchloride and wherein after the heat treatment the resulting image is treated with dichloroethane or acetone.

8. Method according to claim 4, wherein the composition of claim 6 is exposed through a color-dividing negative and wherein the composition includes an indol producing red colored image as the aromatic amine, repeating the exposing, intensification and heat treatment two times with light sensitive compositions including diphenylbenzylamine as the aromatic amine producing blue-colored image and dibenzylaniline to produce a yellow colored image, thereby obtaining a multi-colored image.

* * * * *